US008561304B2

(12) United States Patent
Caswell

(10) Patent No.: US 8,561,304 B2
(45) Date of Patent: Oct. 22, 2013

(54) FOLDING KNIFE WITH ADJUSTABLE NON-LOOSENING STABILITY-ENHANCING PIVOT

(76) Inventor: Joseph Caswell, Newbury Park, CA (US)

( * ) Notice: Subject to any disclaimer, the term of this patent is extended or adjusted under 35 U.S.C. 154(b) by 253 days.

(21) Appl. No.: 13/199,110

(22) Filed: Aug. 19, 2011

(65) Prior Publication Data

US 2012/0047746 A1 Mar. 1, 2012

Related U.S. Application Data

(60) Provisional application No. 61/402,127, filed on Aug. 24, 2010.

(51) Int. Cl.
*B26B 1/02* (2006.01)

(52) U.S. Cl.
USPC ..... 30/157; 30/156; 30/339

(58) Field of Classification Search
USPC ..... 30/155, 161, 156, 157, 331, 339; 411/366, 368, 389, 399, 407
See application file for complete search history.

(56) References Cited

U.S. PATENT DOCUMENTS

| | | | | |
|---|---|---|---|---|
| 1,031,370 | A | 7/1912 | Putney et al. | |
| 4,133,106 | A * | 1/1979 | Addis | 30/160 |
| 4,233,737 | A * | 11/1980 | Poehlmann | 30/335 |
| 4,719,700 | A | 1/1988 | Taylor | |
| 5,794,346 | A * | 8/1998 | Seber et al. | 30/161 |
| 6,101,723 | A | 8/2000 | Ford | |
| 6,134,788 | A * | 10/2000 | Chen et al. | 30/125 |
| 7,146,736 | B1 | 12/2006 | Collins | |
| 7,165,329 | B2 | 1/2007 | Kao | |
| 7,325,312 | B1 | 2/2008 | Janich | |
| 7,716,839 | B2 | 5/2010 | Onion | |
| 7,905,023 | B2 * | 3/2011 | Westerfield | 30/161 |
| 2004/0057811 | A1 * | 3/2004 | Kelzer | 411/389 |
| 2007/0137047 | A1 * | 6/2007 | Kim | 30/161 |
| 2009/0241348 | A1 * | 10/2009 | Westerfield | 30/161 |

* cited by examiner

*Primary Examiner* — Hwei C Payer

(57) ABSTRACT

A folding knife (or tool) having opposing handle halves and at least one knife blade (or tool) pivotally attached there between by an adjustable pivot. The adjustable pivot is configured to rigidly connect the opposing handle halves at the pivot point under load from fully tightened fasteners. The distance between opposing handle halves is both adjustable and rigidly fixable, resulting in improved assembly resistance to deflection from shear and torsion loads and reduced tendency of the blade (or tool) to loosen under hard use.

4 Claims, 5 Drawing Sheets

FOLDING KNIFE WITH ADJUSTABLE NON-LOOSENING STABILITY-ENHANCING PIVOT

CROSS-REFERENCE TO RELATED APPLICATIONS

This application claims the benefit of U.S. Provisional Patent Application 61/402,127 filed on Aug. 24, 2010.

STATEMENT REGARDING GOVERNMENT SPONSORED RESEARCH AND DEVELOPMENT

Not applicable.

FIELD OF INVENTION

This invention relates to pocket knives, and more particularly to a novel adjustable pivot for folding blades or tools that is non-loosening and uniquely beneficial with respect to pocket knife assembly rigidity.

BACKGROUND

Folding tools such as knives generally include a handle comprised of opposed handle halves that are held apart to define a blade-receiving space. A blade is pivotally attached to the handle with a pivot shaft extending between the opposed handle halves and through a bore in the blade thereby defining a connection between blade and handle. The blade may therefore be pivoted between the opposing handle halves from a closed position, in which the blade is stowed safely in the blade receiving space of the handle, and an open position in which the blade extends away from the handle into a position for use.

There are different kinds of structures used for pivot shafts, the oldest being a simple cylindrical post with ends press fit into bores in the opposing handle halves. In some variations, the ends of the pivot shaft extend completely through each handle half and the ends are peened to form heads that prevent the pivot shaft from moving back through the bore, thereby securing the opposite handle halves generally into a predetermined position.

The position of the handle halves with respect to each other is important because it determines how freely the blade will move between the opposing handle halves and can result in conditions ranging from what is colloquially known as "loose" wherein the blade can perceptibly wobble between the opposing handle halves, and "tight" wherein blade movement is impaired by excess friction between the blade the handle halves.

An inherent problem experienced in pivoting knives (and other folding tools) is that any pre-determined tolerance between handle halves is transient when the blade (or tool) is submitted to hard use. Pivoting blades loosen rapidly when the pivot receives axially directed loading from torsion and eccentric tensile loading exerted upon the blade. Furthermore, longitudinal shear loads are transmitted to the handle halves through the pivot ends. This induces deflection within the assembly that greatly contributes to blade loosening.

Traditionally, the solution for blade loosening is occasional readjustment through pressing or re-peening the solid pivot post. Repeated often, however, deformation of the pivot ends and surrounding material caused by this adjustment method results in fatigue and eventually material failure at the pivot ends and the corresponding bores.

Adjustable pivots have been developed to provide a more elegant and repeatable solution to the problem of blade loosening.

While there are different variations known to the art, adjustable pivots for folding knives and tools basically function by squeezing the handle halves together against the blade through compressive axial loading provided by interconnecting adjustable members. Most commonly, this pivot arrangement includes a pivot shaft with internally threaded axial bore opening at one end and a concentric head of greater diameter terminating the other end. Also included is an adjustment screw configured to threadedly interact with the aforementioned internally threaded axial bore. In use, the pivot shaft is fitted through a bore in each opposing handle half with blade pivotally fitted there between. The concentric head of the pivot shaft prevents the pivot shaft from passing completely thorough the bore in one handle half. The assembly is completed when the adjustment screw is inserted through the available bore in the other handle half and into the internally threaded axial bore of the pivot shaft.

Adjustment is facilitated because the pivot shaft is configured to be too short to extend completely through both handle halves while the blade is in place there between. As a result, the pivot shaft extends completely through one handle half and the blade, but only partially through the opposite handle half. Therefore, as the pivot screw is tightened, the pivot shaft is free to move within the partially occupied bore, drawing the handle halves together thereby inducing variable friction upon the blade.

This prior art pivot is well documented in the art and can be found often associated with the disclosures of other inventions. For example, in disclosing a Folding Knife with Safety Device, U.S. Pat. No. 7,165,329 to Kao clearly presents an adjustable pivot typical of the prior art on drawing sheets 4 and 5 of that patent. Similarly, U.S. Pat. No. 7,146,736 to Collins includes drawing sheet 1 depicting this prior art adjustable pivot while teaching a Folding Knife With Cantilevered Spring. U.S. Pat. No. 7,325,312 to Janich for a Folding Knife with Pivoting Blade and Guard shows this prior art adjustable pivot on drawing sheets 2 and 4.

Indeed, the concept of pinching a pivoting blade (or tool) between handle halves, the blade itself serving as spacer between the handle halves, is ubiquitous. The same operational concept underlies many otherwise novel folding knife pivots of record. For example, U.S. Pat. No. 6,101,723 to Ford teaches a Folding Knife With Eccentric Pivot Pin and U.S. Pat. No. 7,905,023 to Westerfield teaches an Adjustable Diameter Pivot Shaft For Hand Tool. Despite their elaborate solutions to different pivot-related problems, all function the same in that they pinch the blade between handle halves and use the pivoting blade as spacer there between.

The primary deficiency with all adjustable folding knife pivots heretofore is that they cannot provide substantial structural support between the two handle halves at the pivot point, resulting in a tendency for the blade to loosen within the assembly when subjected to stress. That is because, unlike a static spacer or standoff that provides normal support against a fully tightened fastener, the adjustable pivots of prior art cannot provide a rigid point of connection between handle halves. Instead, the blade itself governs the distance between the handle halves at this critical location and it must be loose enough to allow the blade to move freely. A loose screw provides both the means of blade adjustment and the primary means for resisting axially directed tensile loads induced between handle halves. The result is insufficient rigidity at the pivot point that allows deflection from shear and torsion loads to rapidly degrade blade adjustment.

SUMMARY

Consistent with the present invention, the aforementioned problems are solved by a fully adjustable pivot that, like a rigid spacer or standoff, independently regulates the distance between handle halves without regard to the presence of the blade and allows the use of fully tightened pivot fasteners to establish a rigid connection between the handle halves precisely at the pivot point without restricting blade movement.

The present invention uniquely provides for adjustment of blade tension by pre-setting the distance between handle halves before the pivot fasteners are fully tightened. This is accomplished by timing the pivot post by threaded interaction with one handle half so that an abutting surface of the pivot post is moved further or closer with respect to that handle half as the pivot post is timed in one direction or the other. The abutting surface of the pivot post abuts a faying surface of the opposing handle half. Thus, distance between handle halves is increased as the pivot is timed in one direction, and decreasing when timed the opposite direction. The opposing handle half is configured to accommodate a means of rigidly fastening the abutting end of the pivot post to the opposing handle half once desired adjustment is achieved. In this case a hole is provided to accept a locking fastener such as a screw that passes through the opposing handle half and into a corresponding internally threaded bore in the pivot post.

As previously described, the timing end of the pivot post is already threadedly connected directly to the opposite handle half as a function of its timing means. In this embodiment, the threaded timing end of the pivot post extends through the corresponding handle half and a locknut is fully tightened over the timing end to lock the pivot post to the handle half in the desired timing position and to ensure rigid connection between the pivot post and handle half.

In accordance with the present invention, the result of the foregoing is a fully adjustable pivot that is also an independent spacing means, rigidly fixing opposing handle halves one to another through the benefits of fully tightened fasteners, positively establishing the distance between opposing handle halves at the pivot point, and securing them against the effects of both compressive and tensile axially directed loads. This rigid interconnection of handle halves at the pivot point dramatically improves assembly rigidity and reduces the tendency of the blade (or tool) to loosen under hard use compared with folding knives (or tools) equipped with adjustable pivots of the prior art.

DESCRIPTION OF DRAWINGS

The foregoing, as well as other objects of the present invention, will be further apparent from the following detailed description of the preferred embodiment of the invention, when taken together with the accompanying specification and drawings in which.

DETAILED DESCRIPTION

Figure 1A:
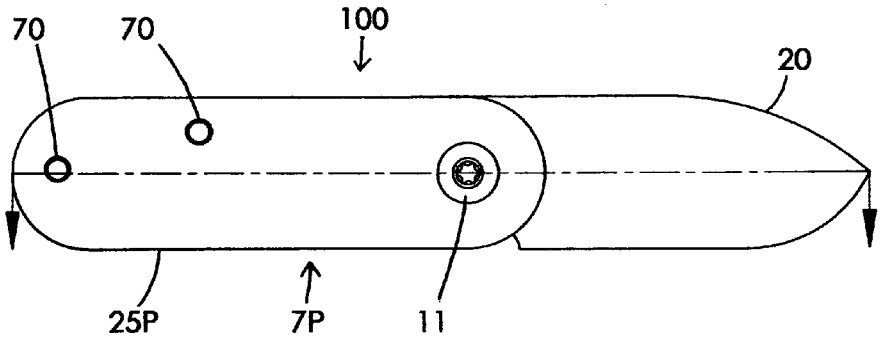
FIG. 1A (PRIOR ART)
FIG. 1A shows an orthogonal view of a knife equipped with an adjustable pivot typical of prior art and further shows a parting line relevant to FIG. 1B.
Figure 1B:
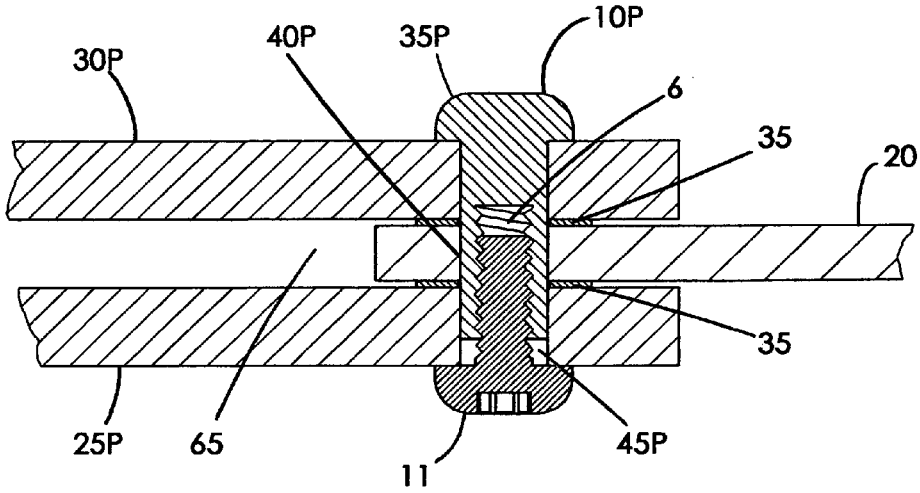
FIG. 1B (PRIOR ART)
FIG. 1B shows a section view of a typical prior art adjustable pivot within the context of a folding knife assembly.
Figure 1C:
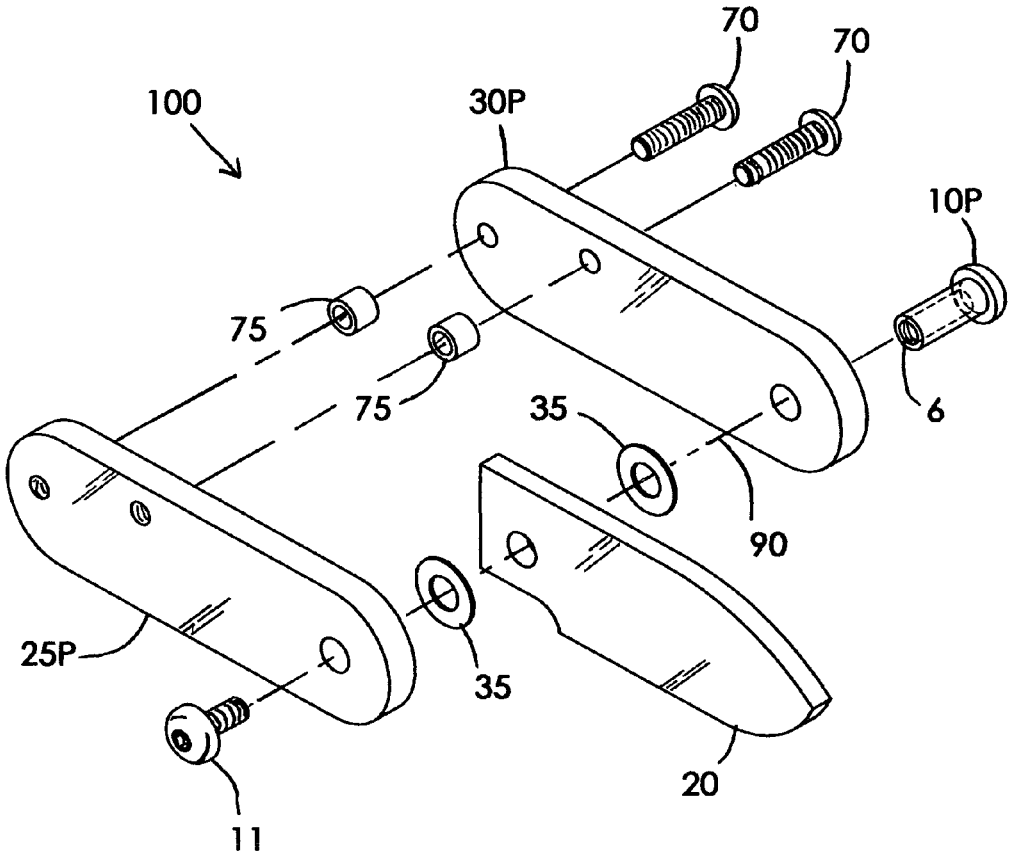
FIG. 1C (PRIOR ART)
FIG. 1C shows an exploded view of a prior art adjustable pivot in the context of an assembly.

FIG. 1A to 1C illustrate a knife equipped with an adjustable pivot assembly typical of prior art. Prior art knife 100 has a prior art handle 7P comprised of opposed halves, first prior art handle half 25P and second prior art handle half 30P (FIG. 1B). These are spaced apart to define a blade-receiving space 65. A blade 20 is pivotally attached to prior art handle 7P (FIG. 1A) with a prior art pivot 10P (FIG. 1B) that extends through a bore in blade 20 thereby defining a pivot axis 90 (FIG. 1C). Blade 20 may be pivoted between a closed position, stowed safely between first prior art handle half 25P and second prior art handle half 30P, and an open position in which blade 20 extends away from prior art handle 7P into the position for use (FIG. 1A). Blade 20 pivots within a pivot plane that is generally perpendicular to pivot axis 90 (FIG. 1C).

It is to be understood that as used herein, "blade" can refer to a number of items including a tool, implement, cutting blade or holder for such tool, implement or cutting blade, and is not to be limited to the blade depicted in the Figures.

FIG. 1B shows that prior art pivot 10P includes a prior art bearing portion 40P about which blade 20 pivots, and a head portion 35P configured so as to prevent prior art pivot 10P from passing through the bore in second prior art handle half 30P. Prior art pivot 10P further includes a threaded shaft 6 configured to receive an adjusting screw 11. A washer 35 is often provided on either side of blade 20 to provide a small and well-defined bearing surface between blade 20 and prior art handle 7P.

In accordance with a typical prior art pivot assembly, section view FIG. 1B reveals that prior art pivot 10P does not extend completely through the bore of prior art handle half 25P, thus providing a gap 45P between prior art pivot 10P and the head of adjusting screw 11. Hence, when adjusting screw 11 is tightened, prior art pivot 10P is drawn through gap 45P reducing the distance between opposing handle halves and exerting compressive loading C upon blade 20 (FIG. 2B). Blade 20 is therefore adjustably pinched between first prior art handle half 25P and second prior art handle half 30P to a desired tolerance coinciding with the preferred tightness of blade 20 (FIG. 1B) with respect to prior art handle 7P (FIG. 1A).

It is to be noted that blade 20 constitutes the spacer between first prior art handle half 25P and second prior art handle half 30P (FIG. 1B). As a result, fully tightening adjustment screw 11 to provide rigid connection between first prior art handle half 25P and second prior art handle half 30P freezes the movement of blade 20. Therefore, connection between first prior art handle half 25P and second prior art handle half 30P must remain sufficiently loose to allow smooth movement of blade 20 should pivot function be preserved.

Figure 2A:
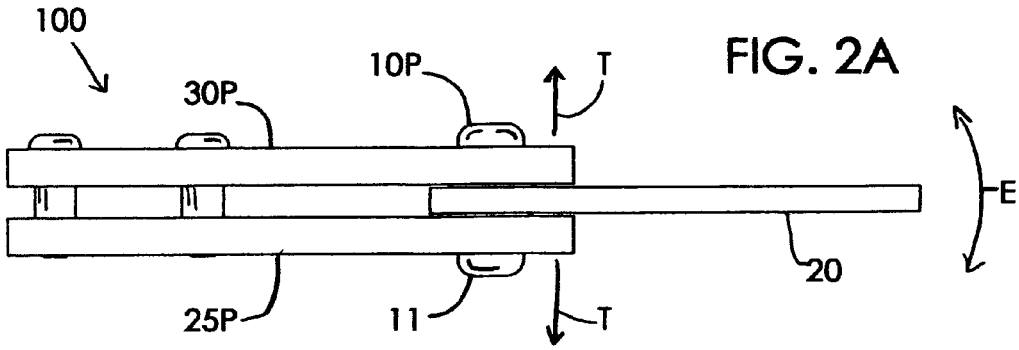
FIG. 2A to 2C shows a prior art folding knife in different views indicating the directions of relevant stress loading referenced in the specifications.
Figure 2B:
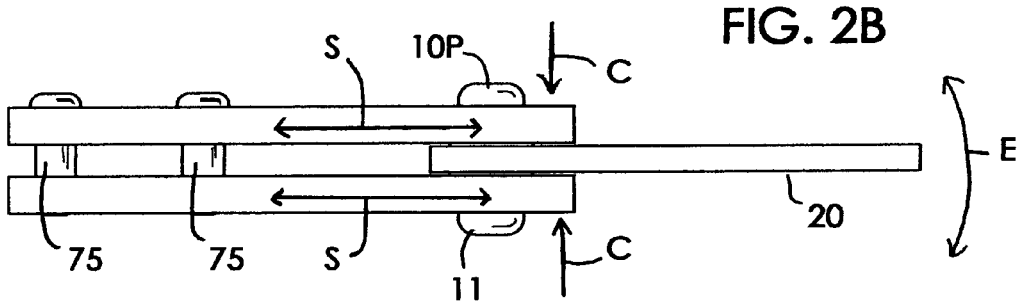
Figure 2C:
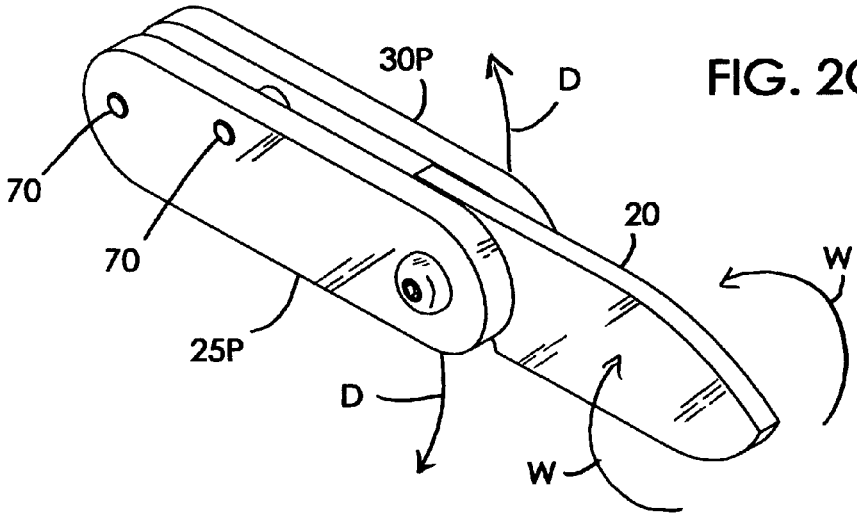

With section view of FIG. 1B in mind, we look to FIGS. 2A to 2C to consider conditions of the use environment common to all folding knives and the implications of such conditions for prior art knife 100 with respect prior art pivot 10P.

FIG. 2A illustrates a top plan view of prior art knife 100 wherein axially directed tensile loading T is encountered from eccentric tensile loading E of blade 20. Adjustment screw 11 is susceptible to loosening under such loads because, unlike a fully tightened fastener, neither the threads nor the head of adjustment screw 11 can generate meaningful friction-induced cohesion with opposing substrates. Deflection from tensile loading T contributes to blade loosening.

FIG. 2B illustrates the direction of longitudinal shear loading S also resulting from eccentric tensile loading E of blade 20. Because there is no rigid connection between first prior art handle half 25P and second prior art handle half 30P at the pivot point and because prior art pivot 10P offers little resistance to deflection and shifting at the pivot point, blade 20 loosens rapidly under hard use.

FIG. 2C is an isometric perspective view of prior art knife 100. In this view the direction of torsion load W upon blade 20 is illustrated. This load is transmitted through prior art pivot 10P to both halves of handle 7P resulting in assembly deflection D. Because there is no rigid connection between first prior art handle half 25P and second prior art handle half 30P at the pivot point and because prior art pivot 10P offers little resistance to assembly deflection D, blade 20 loosens rapidly under hard use.

Even if adjusting screw 11 is permanently locked in place, rigid interconnection between first prior art handle half 25P and second prior art handle half 30P is not established using prior art pivot 10P. That is because blade 20 remains the primary spacer between first prior art handle half 25P and second handle half 30P at the pivot point, and establishing rigid interconnection between first prior art handle half 25P and second prior art handle half 30P by fully tightening adjusting screw 11 destroys basic pivot function (FIG. 1B). Since prior art pivot 10P must allow for loose interconnection between first prior art handle half 25P and second prior art handle half 30P, the aforementioned loading of prior art pivot 10P results in distortion of assembly components and premature wear that, in turn, results in deteriorated blade adjustment.

FIGS. 2A to 2C further illustrate the placement of standoffs 75 in conjunction with screws 70 that are commonly used to positively regulate and rigidly secure the position of the opposing halves of prior art handle 7P at remote locations with respect to prior art pivot 10P. Sometimes a solid spacer (not shown) is used instead of standoffs 75 and fastened between first prior art handle half 25P and second prior art handle half 30P at multiple points. Never-the-less, at least two points of rigid connection between first prior art handle half 25P and second prior art handle half 30P are required for assembly stability. In consideration of the foregoing, prior art pivot 10P does not supply a sufficient point of rigid connection and must be supplemented by standoffs 75 or a spacer (not shown).

Figure 3A:
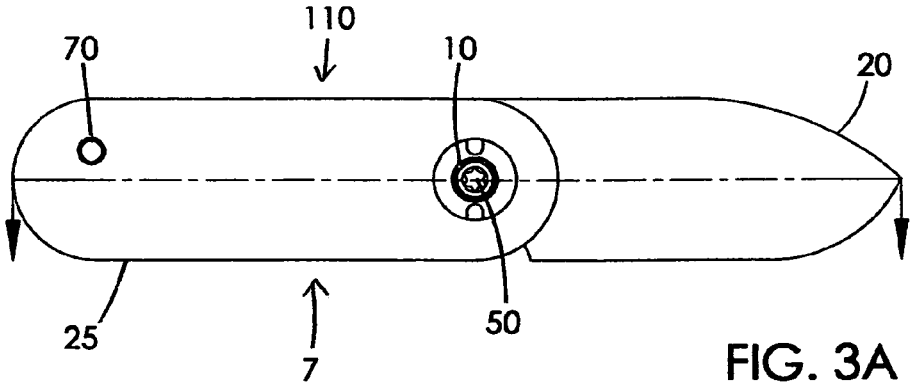
FIG. 3A shows an orthogonal view a knife of the present invention and further shows a parting line relevant to FIG. 3B
Figure 3B:
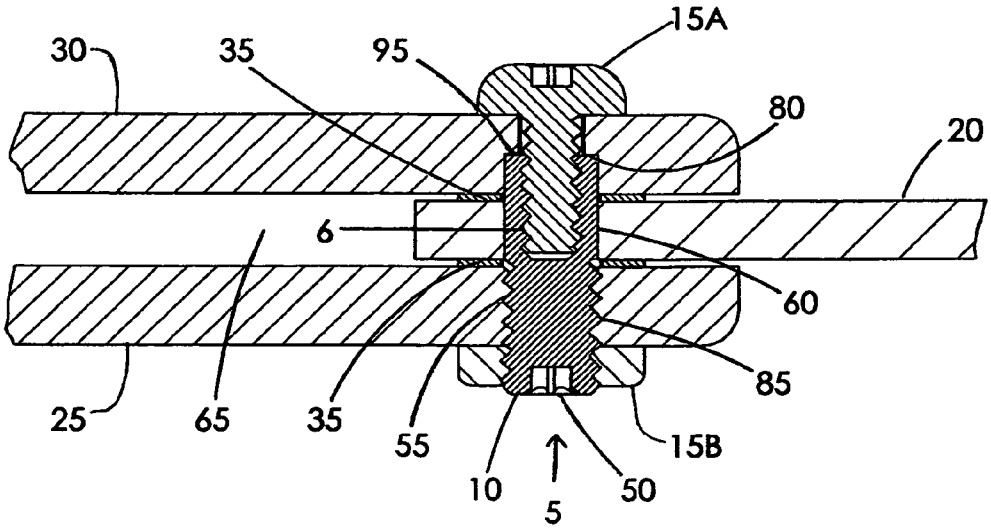
FIG. 3B shows a section view of the knife of the present invention.
Figure 3C:
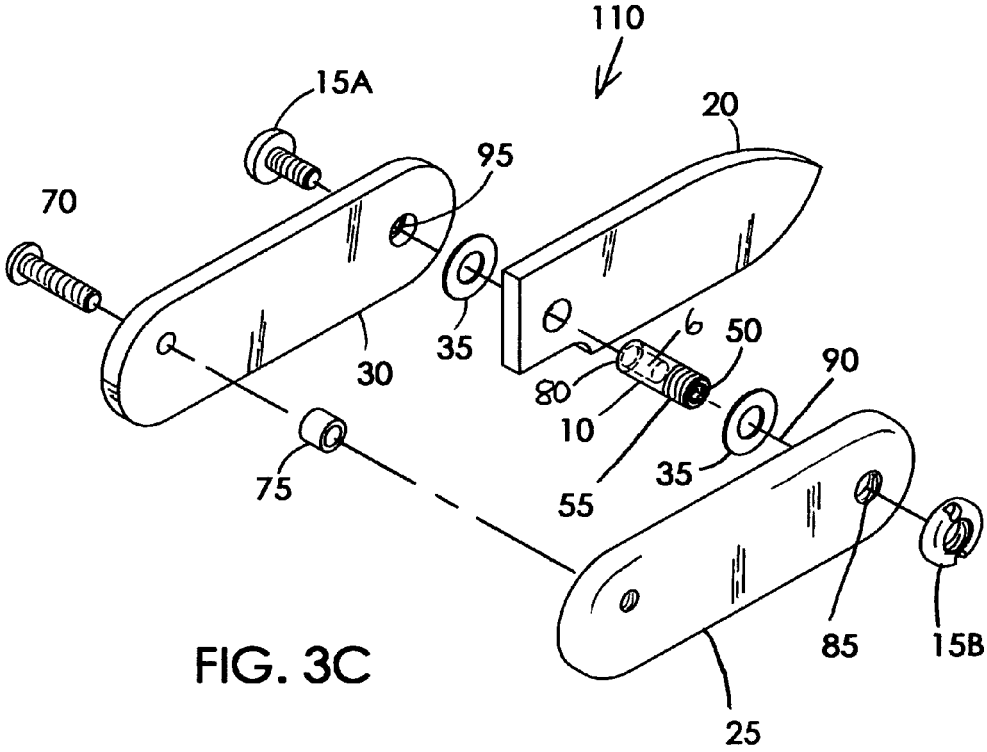
FIG. 3C shows an exploded view of the knife of the present invention.

FIGS. 3A to 3C illustrate a knife 110 of the present invention wherein a handle 7 is comprised of opposed halves, first handle half 25 and second handle half 30. These are held apart to define a blade-receiving space 65 (FIG. 3B). A blade 20 is pivotally attached to handle 7 by pivot assembly 5 which includes a pivot post 10 that extends through a bore in blade 20 thereby defining a pivot axis 90 (FIG. 3C) about which blade 20 may be pivoted between a closed position in which blade 20 is stowed safely between first handle half 25 and second handle half 30, and an open position in which blade 20 extends away from the handle 7 into a position for use (FIG. 3A). Blade 20 pivots within a pivot plane that is generally perpendicular to pivot axis 90.

FIG. 3A is an orthogonal view of knife 110 wherein first handle half 25 of handle 7 is shown and blade 20 is in the extended position.

FIG. 3B is a section view of knife 110 clearly illustrating pivot assembly 5 which includes pivot post 10 thrededly connected to first handle half 25. Pivot post 10 is embodied as a cylindrical post with an externally threaded portion 55 configured to interact with a threaded bore 85 in first handle half 25, and a bearing portion 60 to interact with the pivot bore of blade 20 (FIGS. 3B, 3C).

A timing end 50 provides means by which pivot post 10 may be turned within threaded bore 85 and thereby timed with respect to first handle half 25 (FIG. 3B). Opposite timing end 50 is an abutting surface 80 configured to interact with a faying surface 95 of opposing second handle half 30. In this embodiment, faying surface 95 defines the bottom of a counterbore, but could, for instance, be configured conically to interact with a conical abutting surface (not shown).

In this embodiment, a threaded shaft 6 is provided in pivot post 10 (FIG. 3B). A first locking fastener 15A passes through second handle half 30 and into threaded shaft 6 and, being fully tightened, establishing a rigid connection between pivot post 10 and second handle half 30. Naturally, this arrangement may be reversed and threaded shaft 6 may be replaced with a threaded boss (not shown) extending through a concentric bore in second handle half 30 and mated with a fastening locknut (not shown).

In FIG. 3B, we note that this embodiment includes a second locking fastener 15B configured to be fully tightened about threaded portion 55 of pivot post 10 to lock pivot post 10 to first handle half 25 in a predetermined desired timing position and to ensure rigid connection between pivot post 10 and first handle half 25.

Consulting FIG. 3B, it can be appreciated how distance between first handle half 25 and second handle half 30 is selectively predefined and remains as predefined after first locking fastener 15A and second locking fastener 15B are fully tightened. This is accomplished by timing pivot post 10 relative to first handle half 25 via threaded interaction between threaded portion 55 and threaded bore 85. Abutting surface 80 directly contacts faying surface 95 of second handle half 30. Thus, distance between first handle half 25 and second handle half 30 is increased as pivot 10 is timed in one direction, and decreasing when timed the opposite direction until desired adjustment of blade 20 is realized.

Further consulting FIG. 3B, first locking fastener 15A, which in this embodiment is a locking screw, then passes through second handle half 30 and is fully tightened into threaded shaft 6 in pivot post 10. Timing end 50 of pivot post 10 is already threadedly connected to first handle half 25 as a result of the previously described timing procedure, and extends there through and second locking fastener 15B is fully tightened over timing end 50, locking pivot post 10 to first handle half 25 in the predefined timing position and ensuring rigid connection between pivot post 10 and first handle half 25.

As locking fasteners 15A and 15B are fully tightened, a rigid connection and maximum positional stability is established between first handle half 25 and second handle half 30 at the pivot point and without affecting the predetermined adjustment of blade 20. Further, first locking fastener 15A and second locking fastener 15B enjoy maximum resistance to loosening due to friction-derived cohesion from being fully tightened against respective substrates.

An additional benefit includes the ability to separate first handle half 25 from second handle half 30 for cleaning or to remove and service or replace blade 20 without altering the precise blade-adjustment setting previously determined. By removing first locking fastener 15A and screw 70 (FIG. 3C), first handle half 25 and second handle half 30 may be separated. Since disassembly does not require the removal of locking fastener 15B or any change to the timing position of pivot post 10 with respect to first handle half 25, the distance between first handle half 25 and second handle half 30 is regained unchanged from its previous state upon reassembly.

While embodiments of the invention have been illustrated and described using specific terms, such description is for present illustrative purposes only and it is to be understood that changes and variations to such embodiments, including but not limited to the substitution of equivalent features of parts and the reversal of various features thereof, may be practiced by those of ordinary skill in the art without departing from the spirit or scope of the following claims.

What is claimed is:

1. A folding knife, comprising:

a handle having a first handle half and a second handle half, said first handle half having a first opposing surface, said second handle half having a second opposing surface, said second handle half being spaced apart from said first handle half defining a blade receiving space between said first opposing surface and said second opposing surface; said first handle half further having a threaded bore substantially perpendicular to said first opposing surface, said second handle half having a faying surface generally concentric with said threaded bore of said first handle half; a pivot post having a threaded portion threadedly connected to said threaded bore of said first handle half; the pivot post further having an abutting surface abutting said faying surface of said second handle half; a first locking means by which said abutting surface of said pivot post is rigidly fixed to said second handle half; a second locking means by which said threaded portion of said pivot post is rigidly fixed to said first handle half; a blade pivotally connected to said handle by said pivot post for pivoting about a pivot axis between a position for storage extending generally adjacent said handle and substantially within said blade receiving space and a position for use extending outwardly from said handle.

2. The folding knife of claim 1 wherein said pivot post includes a timing means configured to facilitate turning said pivot post within said threaded bore of said first handle half for selectively regulating the distance between said first opposing surface and said second opposing surface by displacement of said faying surface by said abutting surface of said pivot post.

3. The folding knife of claim 2 wherein said first locking means is a threaded fastener.

4. The folding knife of claim 2 wherein said second locking means is a threaded fastener.

* * * * *